US006452565B1

(12) United States Patent
Kingsley et al.

(10) Patent No.: US 6,452,565 B1
(45) Date of Patent: Sep. 17, 2002

(54) STEERABLE-BEAM MULTIPLE-FEED DIELECTRIC RESONATOR ANTENNA

(75) Inventors: Simon P. Kingsley, Sheffield (GB); Steven G. O'Keefe, Chambers Flat (AU)

(73) Assignee: antenova Limited, Bottisham (GB)

( * ) Notice: Subject to any disclaimer, the term of this patent is extended or adjusted under 35 U.S.C. 154(b) by 0 days.

(21) Appl. No.: 09/431,548

(22) Filed: Oct. 29, 1999

(51) Int. Cl.[7] ..... H01Q 1/40

(52) U.S. Cl. ..... 343/873; 343/700 MS

(58) Field of Search ..... 343/700 MS, 873, 343/785; 392/428, 71, 154, 354, 368; 333/219.1; H01Q 1/38, 1/40

(56) References Cited

U.S. PATENT DOCUMENTS

| | | | | | |
|---|---|---|---|---|---|
| 4,081,803 | A | * | 3/1978 | Dempsey | 343/795 |
| 4,086,597 | A | * | 4/1978 | Sinsky et al. | 343/754 |
| 4,218,682 | A | * | 8/1980 | Yu | 343/700 MS |
| 5,396,202 | A | * | 3/1995 | Scheck | 343/700 MS |
| 5,453,754 | A | * | 9/1995 | Fray | 343/789 |
| 5,483,246 | A | * | 1/1996 | Barnett et al. | 343/700 MS |
| 5,940,036 | A | * | 8/1999 | Oliver et al. | 343/700 MS |
| 5,952,972 | A | * | 9/1999 | Ittipiboon et al. | 343/700 MS |
| 6,147,647 | A | * | 11/2000 | Tassoudji et al. | 343/700 MS |

OTHER PUBLICATIONS

Drossos, G., Wu, Z. and Davis, L.E.: 'Circular polarised cylindrical dielectric resonator antenna', Electron. Lett., 1996, 32 (4), pp 281–283.

Drossos, G., Wu, Z. and Davis, L.E.: 'Switchable cylindrical dielectric resonator antenna', Electron. Lett., 1996, 32 (10), pp 862–864.

Kingsley, S.P. and O'Keefe, S.G., "Beam steering and monopulse processing of probe–fed dielectric resonator antennas", IEEE proceedings—Radar Sonar and Navigation, 146, (3), 121 –125, 1999.

(List continued on next page.)

*Primary Examiner*—Tho Phan
*Assistant Examiner*—Trinh Vo Dinh
(74) *Attorney, Agent, or Firm*—Garvey, Smith, Nehrbass & Doody, L.L.C.; Seth M. Nehrbass

(57) ABSTRACT

A radiating antenna capable of generating or receiving radiation using a plurality of feeds and a dielectric resonator is disclosed. The purpose of using multiple feeds with a single dielectric resonator antenna is to produce several beams each having a 'boresight' (that is, a direction of maximum radiation on transmit, or a direction of maximum sensitivity on receive) in a different direction. Several such beams may be excited simultaneously to form a new beam in any arbitrary direction. The new beam may be incrementally or continuously steerable and may be steered through a complete 360 degree circle. The invention may be combined with an internal or external monopole antenna so as to cancel out the antenna backlobe or otherwise resolve the front/back ambiguity that arises with this type of dielectric resonance antenna. When receiving radio signals, electronic processing of such multiple beams may be used to find the direction of those signals thus forming the basis of a radio direction finding device. Further, by forming a transmitting beam or resolving a receiving beam in the direction of the incoming radio signal, a 'smart' or 'intelligent' antenna may be constructed. The excitation of several beams together can, in some combinations, produce a system with a significantly greater bandwidth than a beam formed by exciting a single probe or aperture. The dielectric resonator is mounted on a ground plane, is preferably substantially cylindrical, and is fed, for example, by a number of internal probes or external ground plane apertures. An internal or external monopole antenna may be added to improve performance.

32 Claims, 5 Drawing Sheets

OTHER PUBLICATIONS

Long, S.A., McAllister, M.W., and Shen, L.C.: 'The resonant cylindrical dielectric cavity antenna', IEEE Trans. Antennas Propagat., AP–31, 1983, pp 406–412.

Mongia, R.K. and Bhartia, P.:'Dielectric resonator antennas—A review and general design relations for resonant frequency and bandwidth', Int. J. Microwave & Millimetre Wave Computer–Aided Engineering, 1994, 4 (3), pp 230–247.

Mongia, R.K., Ittipiboon, A., Cuhaci, M. and Roscoe D.: 'Circular polarised dielectric resonator antenna', Electron. Lett., 1994, 30 (17), pp 1361–1362.

Tam, M.T.K. and Murch, R.D., 'Compact circular sector and annular sector dielectric resonator antennas', IEEE Trans. Antennas Propagat., AP–47, 1999, pp 837–842.

* cited by examiner

STEERABLE-BEAM MULTIPLE-FEED DIELECTRIC RESONATOR ANTENNA

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

This invention relates to dielectric resonator antennas with steerable receive and transmit beams and more particularly to an antenna having several separate feeds such that several separate beams can be created simultaneously and combined as desired.

BACKGROUND OF THE INVENTION

Since the first systematic study of dielectric resonator antennas (DRAs) in 1983 (LONG, S. A., McALLISTER, M. W., and SHEN, L. C.: 'The resonant cylindrical dielectric cavity antenna', IEEE Trans. Antennas Propagat., AP-31, 1983, pp 406–412), interest has grown in their radiation patterns because of their high radiation efficiency, good match to most commonly used transmission lines and their small physical size (MONGIA, R. K. and BHARTIA, P.: 'Dielectric resonator antennas—A review and general design relations for resonant frequency and bandwidth', Int. J. Microwave & Millimetre Wave Computer-Aided Engineering, 1994, 4, (3), pp 230–247). Most configurations reported have used a slab of dielectric material mounted on a ground plane excited by either an aperture feed in the ground plane or by a probe inserted into the dielectric material. A few publications have reported on experiments using two probes fed simultaneously in a circular dielectric slab. These probes were installed on radials at 90° to each other and fed in anti-phase so as to create circular polarisation (MONGIA, R. K., ITTIPIBOON, A., CUHACI, M. and ROSCOE D.: 'Circular polarised dielectric resonator antenna', Electron. Lett., 1994, 30, (17), pp 1361–1362; and DROSSOS, G., WU, Z. and DAVIS, L. E.: 'Circular polarised cylindrical dielectric resonator antenna', Electron. Lett., 1996, 32, (4), pp 281–283.3, 4) and one publication included the concept of switching probes on and off (DROSSOS, G., WU, Z. and DAVIS, L. E.: 'Switchable cylindrical dielectric resonator antenna', Electron. Lett., 1996, 32, (10), pp 862–864).

All references mentioned herein are incorporated herein by reference:

SUMMARY OF THE PRESENT INVENTION

The present invention seeks to provide a DRA having several probes or aperture feeds connected in such a way that the antenna pattern can be steered, and also the use of two probes driven simultaneously in-phase and 180° out of phase in order to generate monopulse sum and difference patterns.

One method of electronically steering an antenna pattern is to have a number of existing beams and to switch between them, or to combine them so as to achieve the desired beam direction. A circular DRA may be fed by a single probe or aperture placed in or under the dielectric and tuned to excite a particular resonant mode. In preferred embodiments, the fundamental $HEM_{11\delta}$ mode is used, but there are many other resonant modes which produce beams that can be steered equally well using the apparatus of embodiments of the present invention. The preferred $HEM_{11\delta}$ mode is a hybrid electromagnetic resonance mode radiating like a horizontal magnetic dipole and giving rise to vertically polarised cosine or figure-of-eight shaped radiation pattern (LONG, S. A., McALLISTER, M. W., and SHEN, L. C.: 'The resonant cylindrical dielectric cavity antenna', IEEE Trans. Antennas Propagat., AP-31, 1983, pp 406–412). Modelling by the present Inventors of cylindrical DRAs by FDTD (Finite Difference Time Domain) and practical experimentation has shown that if several such probes are inserted into the dielectric and one is driven whilst all the others are open-circuit then the beam direction can be moved by switching different probes in and out. Furthermore, by combining feeds in different ways, sum and difference patterns can be produced which allow continuous beam-steering and direction finding by amplitude-comparison, monopulse or similar techniques.

Many of these results are described in the paper KINGSLEY, S. P. and O'KEEFE, S. G., "Beam steering and monopulse processing of probe-fed dielectric resonator antennas", IEE proceedings—Radar Sonar and Navigation, 146, 3, 121–125, 1999, the disclosure of which is incorporated into the present application by reference.

It has been noted by the present inventors that the results described in the above reference apply equally to DRAs operating at any of a wide range of frequencies, for example from 1 MHz to 100,000 MHz and even higher for optical DRAs. The higher the frequency in question, the smaller the size of the DRA, but the general beam patterns achieved by the probe/aperture geometries described hereinafter remain generally the same throughout any given frequency range. Operation at frequencies substantially below 1 MHz is possible too, using dielectric materials with a high dielectric constant.

According to a first aspect of the present invention, there is provided a dielectric resonator antenna including a grounded substrate, a dielectric resonator disposed on the grounded substrate and a plurality of feeds for transferring energy into and from different regions of the dielectric resonator, the feeds being activatable individually or in combination so as to produce at least one incrementally or continuously steerable beam which may be steered through a predetermined angle.

According to a second aspect of the present invention, there is provided a dielectric resonator antenna system including a grounded substrate, a dielectric resonator disposed on the grounded substrate, a plurality of feeds for transferring energy into and from different regions of the dielectric resonator, and electronic circuitry adapted to activate the feeds individually or in combination so as to produce at least one incrementally or continuously steerable beam which may be steered through a predetermined angle.

Advantageously, the antenna and antenna system of the present invention are adapted to produce at least one incrementally or continuously steerable beam which may be steered through a complete 360 degree circle.

Advantageously, there is additionally or alternatively provided electronic circuitry to combine the feeds to form sum and difference patterns to permit radio direction finding capability of up to 360 degrees.

The electronic circuitry may additionally or alternatively be adapted to combine the feeds to form amplitude or phase comparison radio direction finding capability of up to 360 degrees.

Preferably, radio direction finding capability is a complete 360 degree circle.

The feeds may take the form of conductive probes which are contained within or placed against the dielectric resonator or may comprise aperture feeds provided in the grounded substrate. Aperture feeds are discontinuities (generally rectangular in shape) in the grounded substrate underneath the dielectric material and are generally excited by passing a microstrip transmission line beneath them. The microstrip transmission line is usually printed on the underside of the substrate. Where the feeds take the form of probes, these may be generally elongate in form. Examples of useful probes include thin cylindrical wires which are generally parallel to a longitudinal axis of the dielectric resonator. Other probe shapes that might be used (and have been tested) include fat cylinders, non-circular cross sections, thin generally vertical plates and even thin generally vertical wires with conducting 'hats' on top (like toadstools). Probes may also comprise metallized strips placed within or against the dielectric. In general any conducting element within or against the dielectric resonator will excite resonance if positioned sized and fed correctly. The different probe shapes give rise to different bandwidths of resonance and may be disposed in various positions and orientations (at different distances along a radius from the center and at different angles from the center, as viewed from above) within or against the dielectric resonator so as to suit particular circumstances. Furthermore, there may be provided probes within or against the dielectric resonator which are not connected to the electronic circuitry but instead take a passive role in influencing the transmit/receive characteristics of the dynamic resonator antenna, for example by way of induction.

In one embodiment of the present invention, the dielectric resonator may be divided into segments by conducting walls provided therein, as described, for example, in TAM, M. T. K. AND MURCH, R. D., 'Compact circular sector and annular sector dielectric resonator antennas', IEEE Trans. Antennas Propagat., AP-47, 1999, pp 837–842.

Where the dielectric resonator is of generally cylindrical form having a substantially vertical longitudinal axis, for example, the conducting walls are advantageously disposed in a substantially vertical orientation.

The dielectric resonator need not be cylindrical and may have cross-sections other than circular. For example, the resonator may have an oval cross-section or may be annular with a hollow center.

In a further embodiment of the present invention, there may additionally be provided an internal or external monopole antenna which is combined with the dielectric resonator antenna so as to cancel out backlobe fields or to resolve any front/back ambiguity which may occur with a dielectric resonator antenna having a cosine or 'figure of eight' radiation pattern. The monopole antenna may be centrally-disposed within the dielectric resonator or may be mounted thereupon or therebelow and is activatable by the electronic circuitry. In embodiments including an annular resonator with a hollow center, the monopole could be located within the hollow center. A "virtual" monopole may also be formed by the electrical or algorithmic combination of any probes or apertures, preferably a symmetrical set of probes or apertures.

The dielectric resonator antenna and antenna system of the present invention may be operated with a plurality of transmitters or receivers, these terms here being used to denote respectively a device acting as source of electronic signals for transmission by way of the antenna or a device acting to receive and process electronic signals communicated to the antenna by way of electromagnetic radiation. The number of transmitters and/or receivers may or may not be equal to the number of feeds to the dielectric resonator. For example, a separate transmitter and/or receiver may be connected to each feed (i.e. one per feed), or a single transmitter and/or receiver to a single feed (i.e. a single transmitter and/or receiver is switched between feeds). In a further example, a single transmitter and/or receiver may be (simultaneously) connected to a plurality of feeds—by continuously varying the feed power between the feeds the beam and/or directional sensitivity of the antenna may be continuously steered. A single transmitter and/or receiver may alternatively be connected to several non-adjacent feeds to the dielectric resonator, thereby enabling a significant increase in bandwidth to be attained as compared with a single feed (this is advantageous because DRAs generally have narrow bandwidths). In yet another example, a single transmitter and/or receiver may be connected to several adjacent or non-adjacent feeds in order to produce an increase in the generated or detected radiation pattern, or to allow the antenna to radiate or receive in several directions simultaneously.

The dielectric resonator may be formed of any suitable dielectric material, or a combination of different dielectric materials, having an overall positive dielectric constant k; in preferred embodiments, k is at least 10 and may be at least 50 or even at least 100; k may even be very large e.g. greater than 1000, although available dielectric materials tend to limit such use to low frequencies. The dielectric material may include materials in liquid, solid or gas states, or any intermediate state. The dielectric material could be of lower dielectric constant than a surrounding material in which it is embedded.

By seeking to provide a dielectric resonator antenna capable of generating multiple beams which can be selected separately or formed simultaneously and combined in different ways at will, embodiments of the present invention may provide the following advantages:

i) By choosing to drive different probes or apertures, the antenna can be made to transmit or receive in one of a number of preselected directions (in azimuth, for example). By sequentially switching round the probes or apertures the beam pattern can be made to rotate incrementally in angle. Such beam-steering has obvious applications for radio communications, radar and navigation systems.

ii) By combining two or more beams together, i.e. exciting two or more probes or apertures simultaneously, beams can be formed in any arbitrary azimuth direction, thus giving more precise control over the beamforming process.

iii) By electronically continuously varying the power division/combination between two beams, the resultant combination beam direction can be steered continuously.

iv) On receive-only, the direction of arrival of an incoming radio signal can be found by comparing the amplitude of the signal on two or more beams, or by carrying out monopulse processing of the signal received on two beams. 'Monopulse processing' refers to the process of forming sum and difference patterns from two beams so as to determine the direction of arrival of a signal from a distant radio source.

v) In a typical two-way communication system (such as a mobile telephone system) signals are received (by a handset) from a point radio source (such as a base station) and transmitted back to that source. Embodiments of the present invention may be used to find the direction of the source using step iii) above and may then form an optimal beam in that direction using step ii). An antenna capable of performing this type of operation is known as a 'smart' or 'intelligent' antenna. The advantages of the maximum antenna gain offered by smart antennas is that the signal to noise ratio is improved, communications quality is improved, less transmitter power may be used (which can, for example, help to reduce irradiation of any nearby human body) and battery life is conserved.

vi) The addition of an internal or external monopole antenna can be used to null out the backlobe of the antenna, thereby reducing the irradiation of a person near the device, or to resolve front/back ambiguities in radio direction finding.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
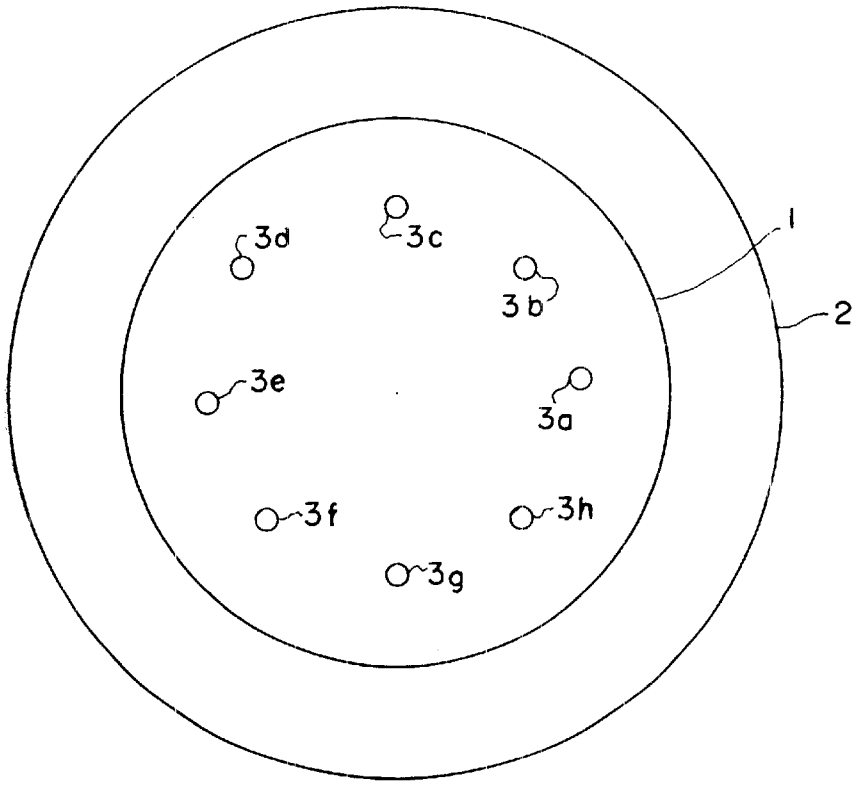
FIG. 1*a* is a top view of a multi-feed dielectric resonator antenna of the present invention using probe feeds.
Figure 1B:
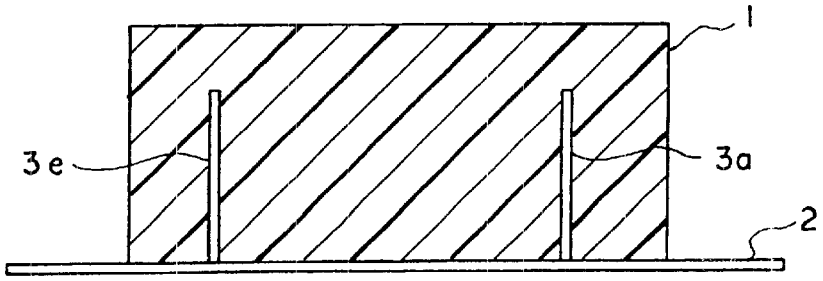
FIG. 1*b* is a side view of the multi-feed dielectric resonator antenna of FIG. 1*a;*

Referring now to FIGS. 1*a* and 1*b*, there is shown a substantially circular slab of dielectric material 1 which is disposed on a grounded substrate 2 having a plurality of holes to allow access by cables and connectors to a plurality of internal probes 3*a* to 3*h*. The probes 3*a* to 3*h* are disposed along radii at different internal angles.

Figure 2A:
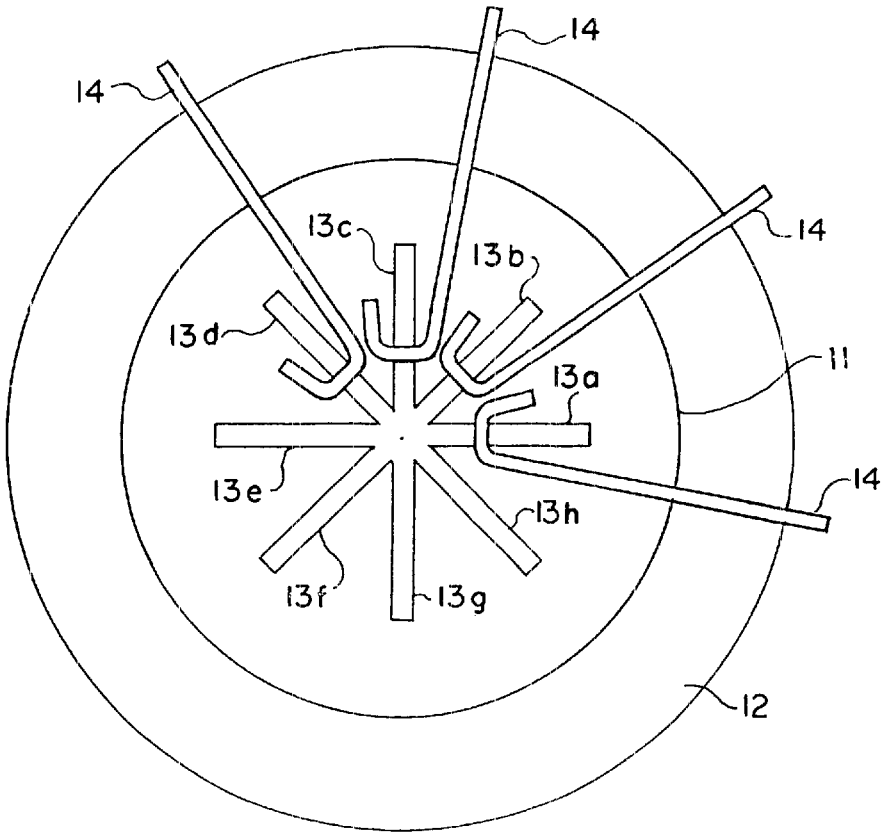
FIG. 2*a* is a top view of a multi-feed dielectric resonator antenna of the present invention using aperture feeds.
Figure 2B:
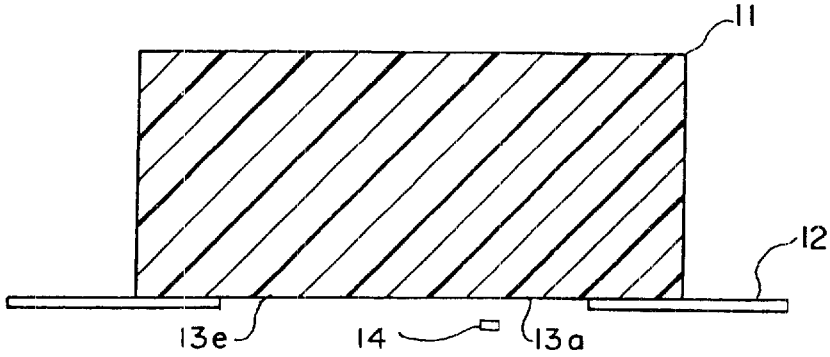
FIG. 2*b* is a side view of the multi-feed dielectric resonator antenna of FIG. 2*a;*

FIGS. 2*a* and 2*b* show a substantially circular slab of dielectric material 11 which is disposed on a grounded substrate 12 having a plurality of aperture feeds 13*a* to 13*h* disposed along radii at different internal angles. The aperture feeds are fed by microstrip transmission lines 14.

Figure 3A:
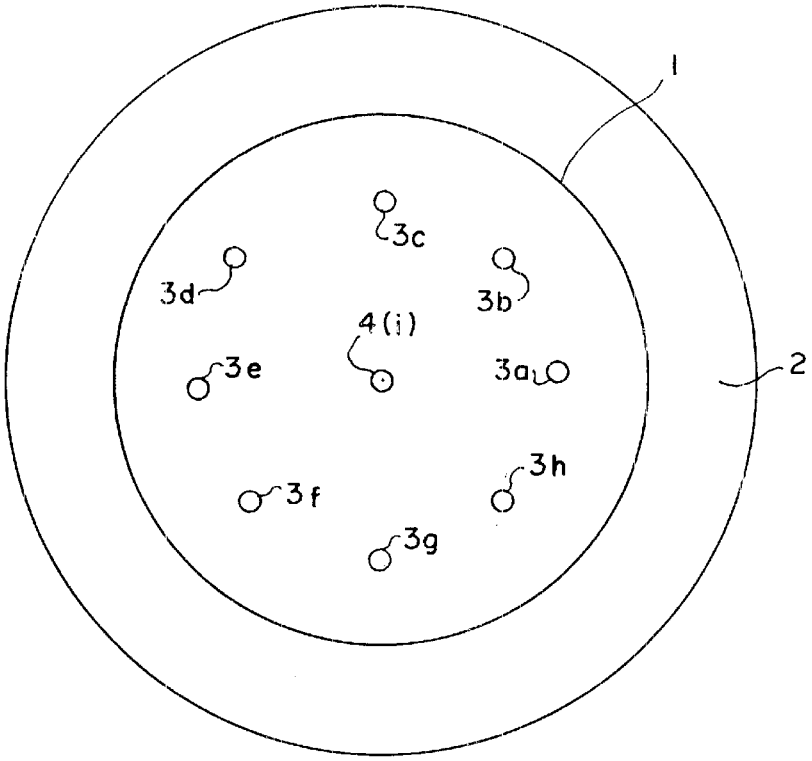
FIG. 3*a* is a top view of a multi-probe dielectric resonator antenna with the addition of a central monopole.
Figure 3B:
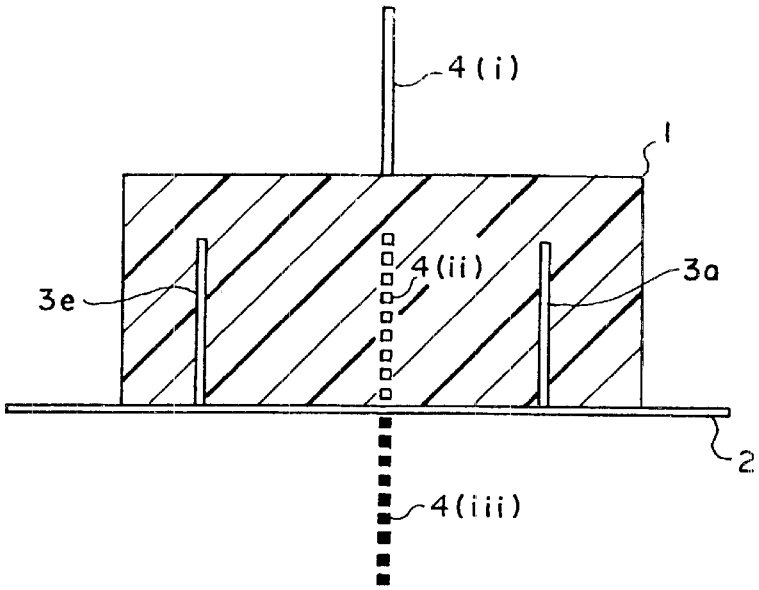
FIG. 3*b* is a side view of the multi-probe dielectric resonator of FIG. 3*a;*

FIGS. 3*a* and 3*b* show the invention for plan and side views respectively, as for FIGS. 1*a* and 1*b*, but with the addition of a central monopole antenna 4(*i*) above the dielectric slab 1 used to cancel out the backlobe or resolve the front/back ambiguity that occurs with dynamic resonator antennas having cosine or 'figure of eight radiation' patterns. In FIG. 3*b* the monopole 4(*i*) is shown as an external device above the dielectric slab 1, but a central probe 4(*ii*) within the dielectric slab 1 will also act as a suitable monopole reference antenna, as will a central probe 4(*iii*) below the slab 1.

The basic concept for a multiple-beam dielectric resonator antenna using a plurality of feeds is given by the present Inventors in the paper KINGSLEY, S. P. and O'KEEFE, S. G., "Beam steering and monopulse processing of probe-fed dielectric resonator antennas", IEE proceedings—Radar Sonar and Navigation, 146, 3, 121–125, 1999. This paper confirms by practical experimentation the present Inventors' FDTD simulation results that multiple-feed operation is possible and that the feeds do not mutually interact electrically in any significant way that prevents the formation of several beams simultaneously.

Since the publication of this paper an 8-probe circular dielectric resonator antenna, having the form shown in FIGS. 1*a* and 1*b* has been constructed and tested. In a further development, an 8-probe circular dielectric resonator antenna with an external monopole antenna, having the form shown in FIGS. 3*a* & 3*b*, has also been constructed and tested.

In FIGS. 4–8, the circular lines represent power steps of 5 dB (decibels) and the arrow shows the direction of the principle beam direction or 'boresight'. The radial lines represent the angle of the beam; this being the azimuth direction when the antenna is placed on a horizontal plane.

Figure 4:
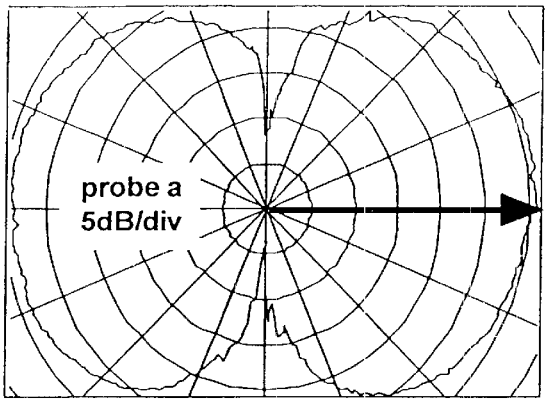
FIGS. 4 to 7 show measured azimuth radiation patterns for the antenna of FIGS. 1*a* and 1*b* as various combinations of probes are driven.

Results for an example of the present invention are given here using a cylindrical dielectric resonator antenna fitted with 8 internal probes 3*a* to 3*h* disposed in a circle. When probe 3*a* is driven (in either transmit or receive mode) and the remaining probes 3*b* to 3*h* are open-circuited or otherwise terminated, but not connected to the feed, then the measured azimuth radiation pattern shown in FIG. 4 is obtained.

Figure 5:
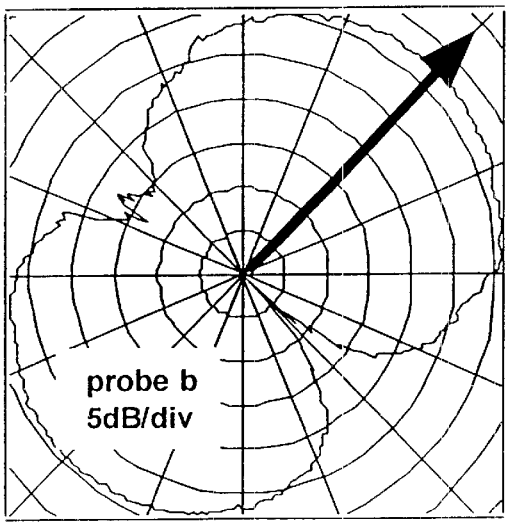
Figure 8:
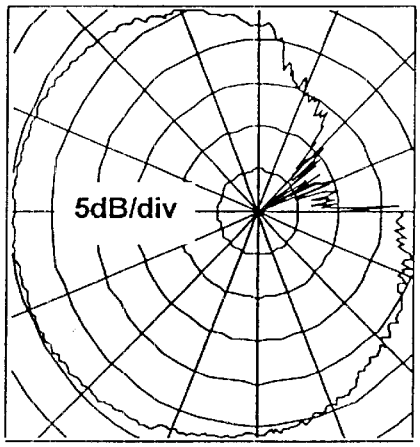
FIG. 8 shows a measured azimuth radiation pattern for the antenna of FIGS. 3*a* and 3*b* as it is simultaneously driven with a monopole antenna.

When probe 3*b* is connected instead of probe 3*a*, the measured azimuth radiation pattern is as shown FIG. 5. It can be seen that the beam has been steered incrementally by roughly the same angle as the probes are disposed internally (45 degrees in this case).

Figure 6:
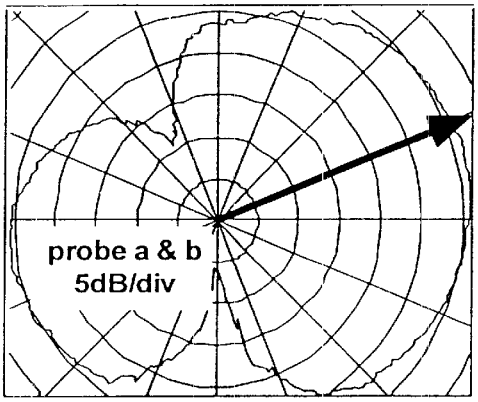

When probes 3*a* and 3*b* are driven simultaneously with equal power from a single source, using a power splitter/divider or similar power sharing device and with the remaining 6 probes open-circuited, the resulting measured azimuth radiation pattern is as shown in FIG. 6. It can be seen that the beam has been steered roughly to an angle between the angles by which the probes are disposed internally (22.5 degrees in this case). This method can be used to continuously steer the beam by continuously varying the feed power being shared between probes. For example, where the power splitter is operated in such a way so as incrementally to transfer power from probe 3*a* to 3*b*, the direction of the transmitted or received beam will be steered correspondingly in proportion to the transfer of power. As the entire azimuth radiation pattern rotates with the beam, the direction of any nulls also changes in a corresponding fashion. In many applications (e.g. missile tracking) it is the null or nulls which are used rather than the beam or beams, particularly since antennas of this type can be made to have deep nulls.

Figure 7:
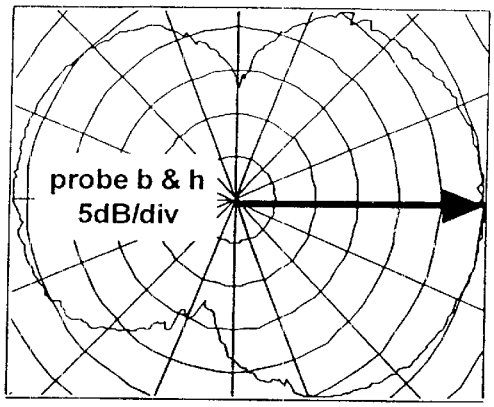

If probes 3*b* and 3*h* are driven simultaneously with the remaining 6 probes being open-circuited, this should produce an azimuth radiation pattern with a boresight (that is, a direction of maximum radiation on transmit, or a direction of maximum sensitivity on receive) in the same direction as probe 3*a* (probes 3*b* and 3*h* being disposed in angle either side of probe 3*a*). FIG. 7 is an experimental result that confirms this. The advantage of feeding two probes this way is that a significant increase in bandwidth can be obtained compared obtained with a single probe.

It can be seen that the patterns of FIGS. 4 to 7 have a significant backlobe, being substantially cosine (figure-of-eight) shaped in form. When transmitting in a given direction this implies a loss of power, when receiving this implies a loss of sensitivity and when direction finding there is a front-to-back ambiguity. The addition of a central internal or external monopole 4(*i*), 4(*ii*), or 4(*iii*), as shown in FIGS. 3*a* and 3*b*, can be used to resolve the ambiguity or, by driving the monopole 4(*i*), 4(*ii*), or 4(*iii*) and one or more of the dielectric resonator steering probes 3 simultaneously, the backlobe can be significantly reduced. This is shown experimentally by the measurements in FIG. 8, where probes 3*e* and 3*f* and the monopole 4(*i*), 4(*ii*), or 4(*iii*) are driven. It is possible to choose whether to cancel out or reduce either the backlobe or a corresponding front lobe by driving the monopole either in phase or in antiphase with the probes 3.

Figure 9:
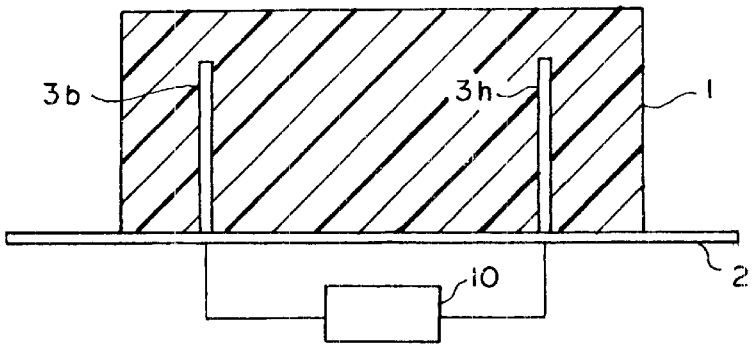
FIG. 9 shows electrical circuitry connected to the feeds.
Figure 10:
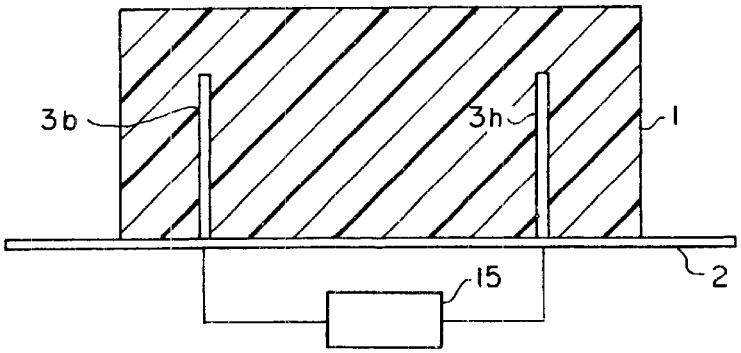
FIG. 10 shows a single transceiver connected to a plurality of non-adjacent feeds.
Figure 11:
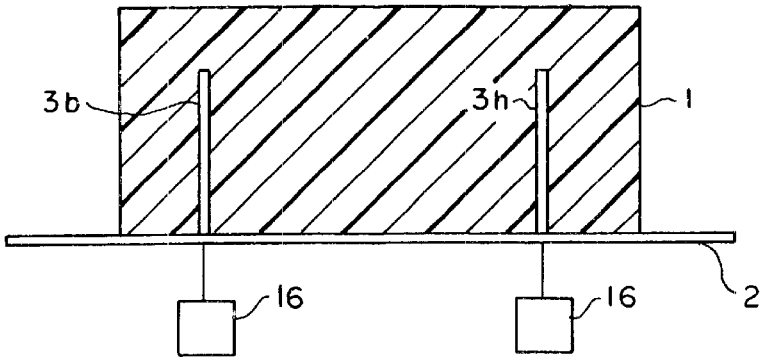
FIG. 11 shows a plurality of transceivers connected to a plurality of feeds.

FIG. 9 shows electrical circuitry 10 connected to the feeds 3*b*, 3*h*. FIG. 10 shows a single transceiver (transmitter or receiver) 11 connected to a plurality of non-adjacent feeds 3*b*, 3*h*. FIG. 11 shows a plurality of transceivers 11 connected to a plurality of feeds 3*b*, 3*h*.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

What is claimed is:

1. A dielectric resonator antenna including a grounded substrate, a dielectric resonator disposed on the grounded substrate and at least three feeds for transferring energy into and from different regions of the dielectric resonator, the feeds being activatable individually or in combination so as to produce at least one incrementally or continuously steerable beam which is steerable through a predetermined angle.

2. A dielectric resonator antenna system including a grounded substrate, a dielectric resonator disposed on the grounded substrate, a plurality of feeds for transferring energy into and from different regions of the dielectric resonator, and electronic circuitry to activate the feeds individually or in combination so as to produce at least one incrementally or continuously steerable beam which is steerable through a predetermined angle.

3. The antenna system of claim 2, wherein the steerable beam is steerable through a complete 360 degree circle.

4. The antenna system of claim 2, wherein the electronic circuitry includes means to combine the feeds to form sum and difference patterns to permit radio direction finding capability of up to 360 degrees.

5. The antenna system of claim 2, wherein the electronic circuitry includes means to combine the feeds to form amplitude or phase comparison radio direction finding capability of up to 360 degrees.

6. The antenna system of claim 2, wherein the feeds take the form of conductive probes which are contained within or against the dielectric resonator.

7. The antenna system of claim 2, wherein the feeds take the form of apertures provided in the grounded substrate.

8. The antenna system of claim 7, wherein the apertures are formed as discontinuities in the grounded substrate underneath the dielectric resonator.

9. The antenna system of claim 8, wherein the apertures are generally rectangular in shape.

10. The antenna system of claim 7, wherein a microstrip transmission line is located beneath each aperture which is to be excited.

11. The antenna system of claim 10, wherein the microstrip transmission line is printed on a side of the substrate remote from the dielectric resonator.

12. The antenna system of claim 5, wherein the feeds take the form of conductive probes which are contained within or against the dielectric resonator, and a predetermined number of the probes within or against the dielectric resonator are not connected to the electronic circuitry.

13. The antenna system of claim 12, wherein the probes are unterminated (open circuit).

14. The antenna system of claim 12, wherein the probes are terminated by a load of any impedance, including a short circuit.

15. The antenna system of claim 2, wherein the dielectric resonator is divided into segments by conducting walls provided therein.

16. The antenna system of claim 2, wherein there is provided an internal or external monopole antenna which is combined with the dielectric resonator antenna so as to cancel out backlobe fields or to resolve any front/back ambiguity which may occur with a dielectric resonator antenna having a cosine or 'figure of eight' radiation pattern.

17. The antenna system of claim 16, wherein the monopole antenna is centrally disposed within the dielectric resonator.

18. The antenna system of claim 16, wherein the monopole antenna is mounted above the dielectric resonator.

19. The antenna system of claim 16, wherein the monopole antenna is mounted below the dielectric resonator.

20. The antenna system of claim 16, wherein the monopole antenna is formed as an electrical combination of the feeds.

21. The antenna system of claim 16, wherein the monopole antenna is formed as an algorithmic combination of the feeds.

22. The antenna system of claim 2, wherein the dielectric resonator is formed of a dielectric material having a dielectric constant k>10.

23. The antenna system of claim 2, wherein the dielectric resonator is formed of a dielectric material having a dielectric constant k>50.

24. The antenna system of claim 2, wherein the dielectric resonator is formed of a dielectric material having a dielectric constant k>100.

25. The antenna system of claim 2, wherein the dielectric material is a liquid.

26. The antenna system of claim 2, wherein the dielectric material is a solid.

27. The antenna system of claim 2, wherein the dielectric material is a gas.

28. The antenna system of claim 2, wherein a single transmitter or receiver is connected to a plurality of feeds.

29. The antenna system of claim 2, wherein a plurality of transmitters or receivers are individually connected to a corresponding plurality of feeds.

30. The antenna system of claim 2, wherein a single transmitter or receiver is connected to a plurality of non-adjacent feeds.

31. A dielectric resonator antenna system including a grounded substrate, a dielectric resonator disposed on the grounded substrate, at least three feeds for transferring energy into and from different regions of the dielectric resonator, and electronic circuitry for activating the feeds individually so as to produce at least one incrementally steerable beam which is steerable through a predetermined angle.

32. A dielectric resonator antenna system including a grounded substrate, a dielectric resonator disposed on the grounded substrate, at least three feeds for transferring energy into and from different regions of the dielectric resonator, and electronic circuitry for activating the feeds by varying a power division between the feeds so as to produce at least one incrementally or continuously steerable beam which is steerable through a predetermined angle.

* * * * *